United States Patent [19]

Bethoon et al.

[11] Patent Number: 4,506,688

[45] Date of Patent: Mar. 26, 1985

[54] PORTABLE SHELTERS

[76] Inventors: Walter D. Bethoon, 219 N. Myers St., Burbank, Calif. 91505; Roderick C. Shepard, 5408 Pine Cone Rd., La Crescenta, Calif. 91214

[21] Appl. No.: 472,904

[22] Filed: Mar. 7, 1983

[51] Int. Cl.[3] ..... A45F 1/14

[52] U.S. Cl. ..... 135/107; 135/117; 135/112

[58] Field of Search ..... 135/102, 104, 112, 118, 135/900-902, 98, 16, 20, DIG. 5, DIG. 8, 107, 117; 272/113; D21/253

[56] References Cited

U.S. PATENT DOCUMENTS

| | | | |
|---|---|---|---|
| 998,093 | 7/1911 | Hill | 135/902 |
| 1,602,980 | 10/1926 | Jacque | 135/107 |
| 1,854,671 | 4/1932 | Roberts | 135/98 |
| 2,266,853 | 12/1941 | Dabney | 135/104 |
| 2,840,092 | 6/1958 | Hill | 135/118 |
| 2,934,076 | 4/1960 | Fulke | 135/118 |
| 4,069,832 | 1/1978 | Bingham | 135/107 |
| 4,097,043 | 6/1978 | Rudy | 272/113 |

FOREIGN PATENT DOCUMENTS

| | | | |
|---|---|---|---|
| 654505 | 12/1962 | Canada | 135/109 |

*Primary Examiner*—Richard J. Apley
*Assistant Examiner*—S. R. Crow
*Attorney, Agent, or Firm*—Nilsson, Robbins, Dalgarn, Berliner, Carson & Wurst

[57] ABSTRACT

A portable shelter having a tripod-type frame for supporting a fabric cover along the center thereof with the cover being spread by stretch bows retained upon the frame. Each of the legs of the tripod is adjustable as to height and pivot to provide a compact structure easily stowed in a hand-carry bag.

15 Claims, 7 Drawing Figures

PORTABLE SHELTERS

BACKGROUND OF THE INVENTION

The present invention relates to shelters and more particularly to shelters which are portable, easily assembled and are collapsible for ease of storage.

A portable protective shelter can provide welcome relief for the person who enjoys spending time outdoors such as at the beach, lake or in the backyard, but prefers to do so without sitting in the hot sun. However, the average outdoor-oriented person does not want a portable shelter which is heavy and clumsy to carry or is complicated to assemble. A portable shelter should not unduly restrict the user's movement and vision when the user is inside the shelter.

Variour prior art portable shelters provide relief to users from the sun and the earth's elements. For example, Fulk U.S. Pat. No. 2,934,076 shows a beach cabana which is designed to be a portable, lightweight shelter for use on the beach. The Fulk patent teaches a beach cabana having three walls and a roof which can be easily folded when ready to leave the beach. This cabana generally comprises a rectangular fabric covering which is rigidly supported by three horizontal rods or tubes which are in turn held in place by a collapsible frame. The frame structure is further supported by several guy wires which are attached to steel spikes pounded into the ground.

The Moss U.S. Pat. No. 3,394,720, also shows a portable canopy or shelter which can be readily used for outdoor purposes. Moss teaches a shelter which relies upon a single resilient pole to support a single sheet of flexible material which forms the shelter. The resilient pole is received within a tunnel or sleeve which is formed in the sheet of material and extends along the peak of the shelter. The shelter further includes a base socket for receiving one end of the resilient pole with two rigid arms radiating from the socket along the ground. The shelter is formed by flexing the pole and connecting the corners of the sheet to the outer ends of the rigid arms.

The Beaudry U.S. Pat. No. 4,355,650 discloses a portable shelter including a plurality of bows attached at each end to a pair of hubs. Side braces interconnect the bows in their extended positions and are pinned to them. One edge of the shelter rests on the ground and the shelter is held in place by an anchor buried in the ground.

Unfortunately, some of the problems associated with the shelters to which the present invention relates, has been in the assembly and disassembly of the device. While some prior art shelters are readily collapsible, many rely upon guy wires for support or to anchor the structure, which not only requires tie down wires, but may also require use of different tools to secure stakes in the ground or to dig holes in the ground.

SUMMARY OF THE INVENTION

The present invention comprises a portable, collapsible shelter which can be easily assembled by one person for use as a protective covering. This portable, collapsible shelter comprises a frame means, which receives and stretches a flexible covering material which forms the protective shelter. The frame includes a tripod structure which disposes the flexible covering material completely above the ground. The frame means including the tripod support structure is interconnected by pivot means, which enables the structure to be collapsed to a small size for easy storage and carrying.

The frame means which receives and stretches the flexible covering material further includes a central support rod which supports and separates a first stretch bow and a second stretch bow which receives the flexible covering material in sleeves which are formed from looped portions in the flexible covering material. The tripod structure further includes a front support leg and two rear support legs which are connected respectively to opposite ends of the central support rod by the interconnecting means. The interconnecting means also includes fastening means for securing the first and second stretch bows to the central support rod.

While portable shelters are not new in the art, the portable, collapsible shelter of the present invention is unique because of its compact and lightweight design and its ease of assembly. The present invention overcomes problems associated with the shelters in the prior art by forming the support elements to include slidably engageable fastening devices. This invention also eliminates the need to use guy wires or other tie down devices to help support the structure.

The present invention can be used at locations which lack adequate shade, thus providing a protective cover from the sun's rays. Also, this invention can be erected in the shallow portion of a lakebed, thus permitting the user to sit in cool water while staying out of the hot sun. This portable shelter can be also used as a blind for camouflauge while hunting or it can be used as a small open-ended tent by lowering the front support leg to the ground.

Shelters constructed according to the present invention may generally be used by several persons at one time. While the shelter can remain errcted for an indefinite period, this type of shelter is usually used for the day and thereafter removed. Therefore, some of the features and advantages of such a shelter are compactness, light weight and ease of assembly and disassembly.

Portable shelters of the present invention are to be distinguished from shelters of a more permanent nature such as traditional tents. While these latter shelters are also intended to be portable and collapsible for movement from place to place, they are used more often as temporary housing or storage units, rather than a shelter from the sun. Also, these latter types of shelters are considerably larger to provide greater security for people and supplies and, therefore, require a more complex assembly.

DETAILED DESCRIPTION OF THE PREFERRED EMBODIMENT

Figure 1:
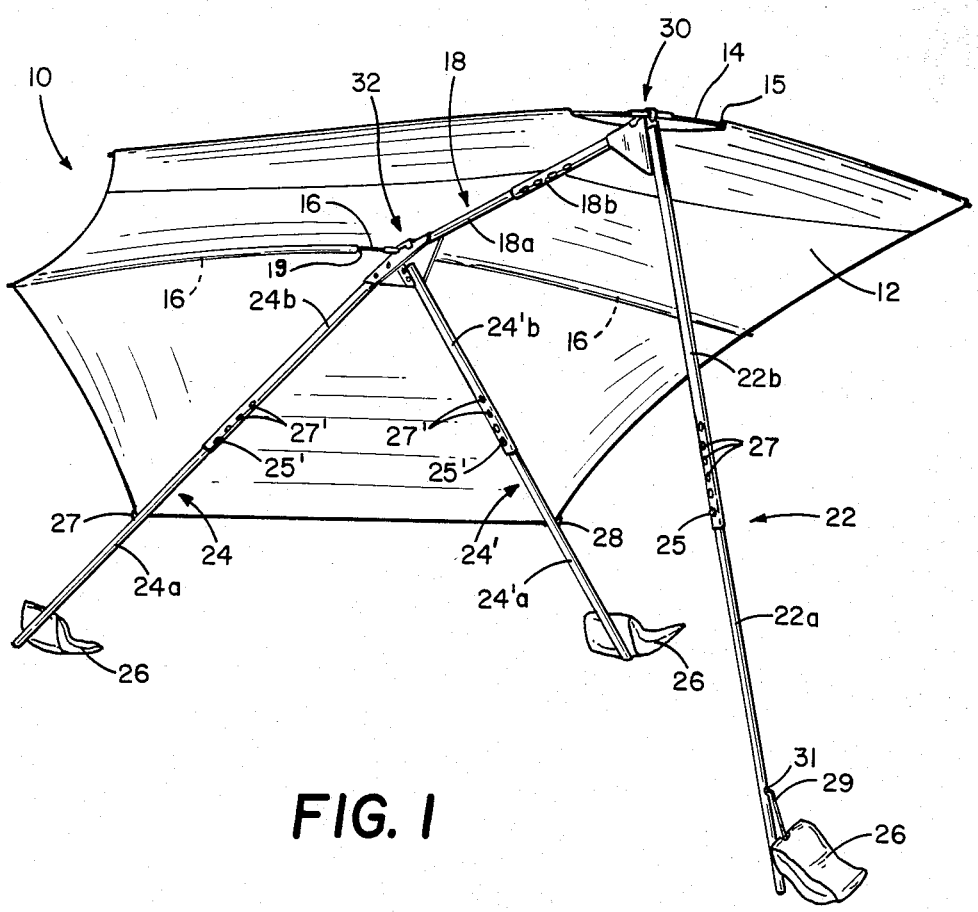
FIG. 1 is a perspective view of the portable, collapsible shelter in accordance with the invention.

A portable, collapsible shelter 10 constructed in accordance with the present invention is illustrated in FIG. 1. The portable, collapsible shelter 10 comprises a flexible covering material 12 supported by a frame means which includes a central support rod 18 which supports and separates a first stretch bow 14 and a second stretch bow 16. The central support rod 18 is further supported above the ground by a tripod structure which comprises a front support leg 22 and two rear support legs 24-24'. The front support leg 22 is attached to one end of the central support rod 18 by a first interconnecting means 30. The two rear support legs 24-24' are attached to the opposite end of the central support rod by a rear interconnecting means 32.

The flexible covering material 12 includes a front sleeve 15, which receives the first stretch bow 14. The flexible covering material 12 also includes an intermediate sleeve 19, which receives the second stretch bow 16. The flexible covering material 12 extends from the second stretch bow 16 and is attached at spaced apart points to the rear support legs 24-24' by a fastening means such as the hooks 27 and 28.

The stretch bows 14 and 16 are utilized to stretch the covering material 12 into the desired position for use as a shelter and to retain it in that position during use without the necessity of guy wires or support legs at the corners of the shelter material 12, as has been required by prior art devices. The stretch bows are held in place at each end of the central support rod 18 (as will be more fully described hereinafter), and the flexible covering material 12 is held in place on the stretch bows by a grommet disposed in the outer edges of the material 12 at positions such that the ends of the stretch bows can be inserted into a grommet, thereby causing the stretch bows to assume the desired curved shape and properly hold the material in position. As was previously indicated, the remaining corners of the flexible covering material 12 may be secured to the supporting frame member by the hooks 27 and 28 being secured to the rear legs 24-24' respectively.

The front support leg 22 includes two separate leg portions **22*a* and 22*b* which are slidably received one within the other. The leg portion 22*a* can be fastened within the leg portion 22*b* by a spring loaded tab or button 25 which protrudes through an opening 27 which is defined by the leg portion 22*b*. Several positions on leg portion 22*b* can be provided to adjust the length of the front support leg 22 depending upon the weather and terrain conditions. Two separate rear leg portions 24*a*, 24*b* and 24'*a*-24'*b* can be slidably received one within the other to form the rear support legs 24-24'. Again, the leg portions can be fastened within one another by a spring loaded tab 25' which can protrude through an opening 27'** which is located on each respective leg portion. Again, such a structure allows the user to adjust independently the length of each of the tripod legs to accommodate the particular conditions of use.

The front support leg 22 and the two rear support legs 24-24' can be held down in the event of wind by bags 26 which can be filled with materials such as sand, dirt or rocks and attached to each respective leg by a fastening means 29. The fastening means 29 can be a simple strap and hook which fits into a hole 31 located near the bottom of each support leg.

Figure 2:
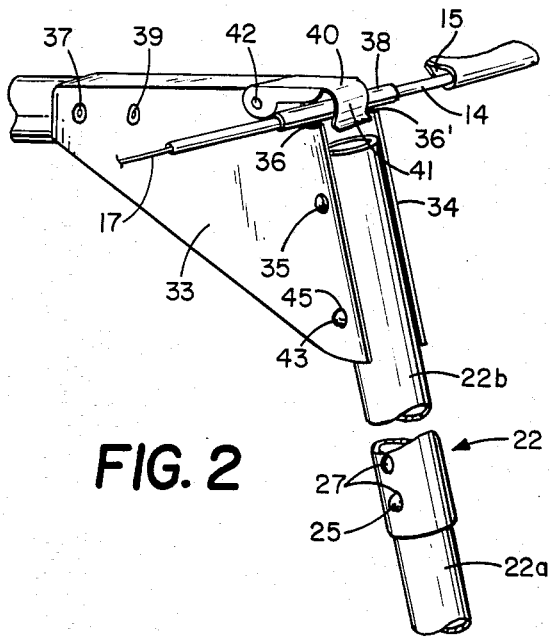
FIG. 2 is a perspective view showing the front interconnecting means.
Figure 3:
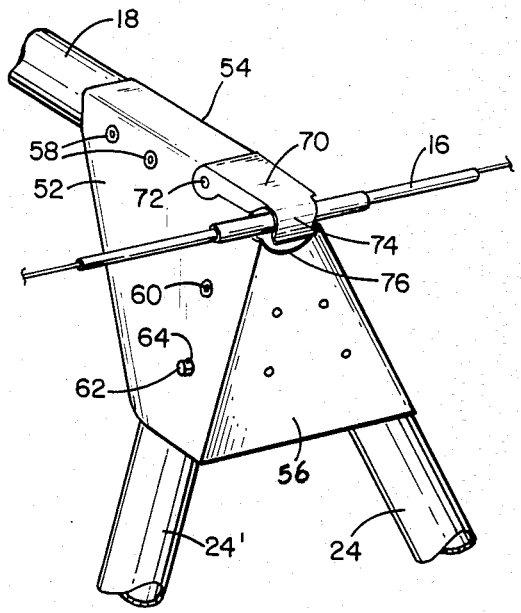
FIG. 3 is a perspective view showing the rear interconnecting means.

FIGS. 2 and 3 illustrate the means by which the tripod legs 22 and 24-24' are attached to the central support member rod 18. As will be noted the legs 22 and 24-24' are pivotally connected to the rod 18, thereby permitting total collapse of the legs into alignment with the support rod 18, as well as the telescoping of the legs as above described to thereby provide reduction of the support members to a small and readily handable size for storage and transportation. In addition, the front leg 22 may be pivoted into alignment with the rod 18, thereby allowing the user to lower the stretch bow 14 into contact with the ground. As will readily be seen, this provides a means of some security for items which may be left by the user at a particular site when they are gone. Alternatively, this ability to lower the stretch bow 14 into contact with the ground may be utilized in the event of particularly high winds that may otherwise tend to raise the entire structure into the air, even though the anchoring means is in position. In addition, the shelter when thus lowered can be used as a small open-ended tent.

Again, referring to the preferred embodiment of the portable collapsible shelter 10 as shown in FIG. 1, the central support rod 18 comprises two rod portions **18*a* and 18*b* which are slidably engaged and disengaged one within the other to provide an even more compact size for storing the shelter. The frame means may be constructed of any desired material, but preferably is fabricated from galvanized steel or aluminum poles. The stretch bows 14 and 16 are preferably constructed from a flexible material such as fiberglass. The flexible covering material 12** is preferably polyurethane coated nylon.

Figure 4:
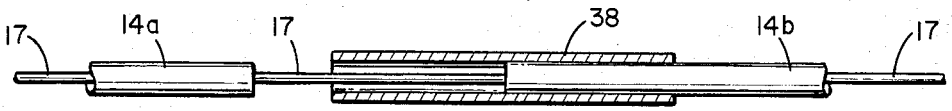
FIG. 4 is a partial cross-sectional view showing the stretch bow and holder.

By reference to FIG. 4 there is illustrated in detail the construction of the stretch bows 14 and 16. As is therein shown, a stretch bow, for example bow 14, includes sections **14*a* and 14*b* which are interconnected and held togeter by a flexible elastic member 17 through the use of a sleeve 38 constructed of a metallic cylinder which is frictionally held in place to bridge a gap between the sections 14*a* and 14*b* of the stretch rod. That is, when the two ends are permitted to come together by allowing the elastic 17 to pull them together the sleeve 38 may be slidably moved from the position shown in FIG. 4, so that it totally bridges the gap between the sections 14*a* and 14*b*. Stretch bow 16 is constructed similarly to stretch bow 14. In this manner the tubular sleeve or sheath completes the stretch bows 14 and 16 as will be readily recognized by those skilled in the art. When the shelter is being dismantled and stored the sleeve 38 can be moved to the position shown in FIG. 4, and as a result of the elastic member 17, the two portions 14*a* and 14*b* of the stretch bow 14 (and the similar construction for stetch bow 16) can then be brought together thereby allowing the flexible covering material 12 to be effectively rolled up about the stretch bows, the support rod 18 and the legs 22 and 24-24', all of which are brought together and lie along the same general line as does the central support rod 18**. It is through this unique combination of elements and the manner in which they are pivoted together and easily collapsed that provides the unique, lightweight portable and easily stored shelter of the present invention.

Referring again to FIGS. 2 and 3, the means for securing the stretch bows 14 and 16 in position upon the central support rod 18 are more fully illustrated. As is shown, for example, in FIG. 2 the front leg 22 is pivotally secured between plates 33 and 34 by a pin 35. Each of the plates 33 and 34 defines a notch or recess 36-36' which effectively defines a channel in which the cylindrical sleeve or sheath 38 is disposed, thereby to retain the stretch bow 14 in position. A securing means such as a tongue 40 is pivotally secured by a pin 42 to the plates 33 and 34 and includes a downwardly (as viewed in FIG. 2) directed flange 41, which overlaps the cylindrical sleeve or sheath 38, thereby to securely fasten the stretch bow 14 to the frame means.

As is more clearly shown in FIG. 2, the leg 22 is held in place when the shelter is in its erected position by a spring loaded detent 43, which is received within an opening 45 provided in the plate 33. A similar detent and opening is provided on the plate 34, but is not illustrated in FIG. 2. The central support rod 18 is also disposed between the plates 33 and 34, and is held in place by a fastening means, such for example as rivets 37 and 39. The top portion of the central support rod is positioned below the top of the plates 33 and 34 by an amount sufficient to allow the pin 42 to easily extend between the plates 33 and 34, thereby allowing the tongue 40 to easily pivot from the position shown on FIG. 2 to an upwardly raised position, whereby the stretch bow 14 could be removed from notches 36-36'.

As shown more clearly in FIG. 3 the rear legs 24-24' are supported between plates 52, 54 and 56. Again the central support rod 18 is held in position between the plates 52 and 54 by fastening means, such as rivets 58. The leg 24' is pivotally secured through the plate 52 by a pin 60 and when the shelter is in its erected position, the leg 24' is held in its position by the spring loaded detent 62, which extends through the opening 64 provided in the plate 52. A similar structure enables the leg 24 to be secured to the plate 54.

Figure 3A:
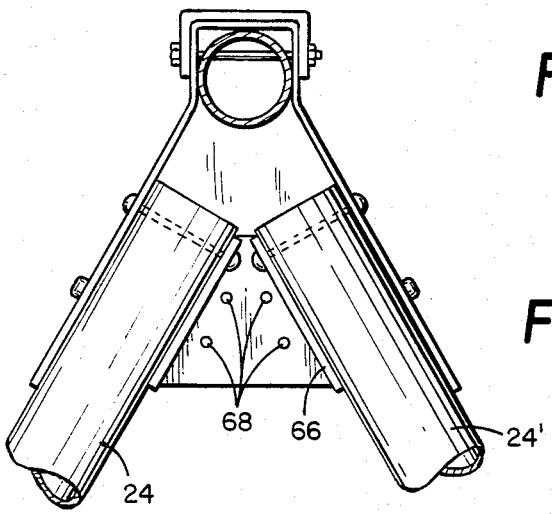

That is more clearly shown in FIG. 3*a*, which is a view taken internally of the structure shown in FIG. 3. An additional plate 66 is secured to the plate 56 by fastening means such as the rivets 68. The plate 66 provides additional support for the legs 24-24', as is seen, and provides additional means for anchoring the pivot pins, about which the legs rotate when erecting or collapsing the structure.

An additional securing means such as the tongue 70 is pivotally attached by the pivot pin 72 between the plates 52 and 54. The tongue 70 has a downwardly directed flange 74, which secures the rear stretch bow 16 in place within a channel formed by appropriate notches or recesses formed within the plates 52, 54 and 56. As is illustrated generally at 76, the function of the securing means 70 is precisely the same as the securing means 40, and thus additional description thereof is not deemed required.

Figure 5:
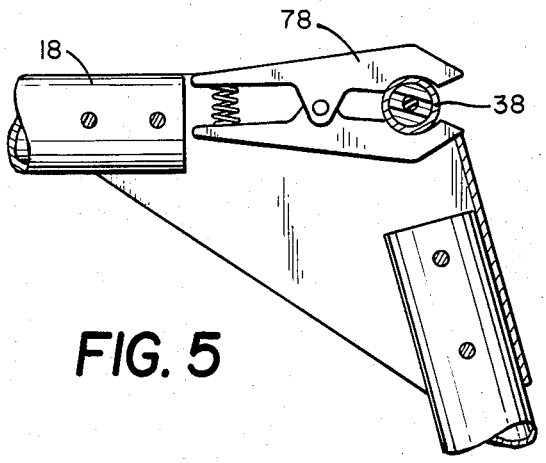
FIG. 5 is a cut away view of the jaw fastening means.

An alternative arrangement to the tongues 40 and 70 used in the front and rear interconnecting means 30 and 32, is a pair of spring loaded jaws 78, which are shown in FIG. 5. These spring loaded jaws 78 can be retracted to receive the cylindrical sleeve 38 and then close to secure the stretch bows in place. As is shown in FIG. 5, these spring loaded jaws 78 can be located in the same location where the tongues are positioned.

Figure 6:
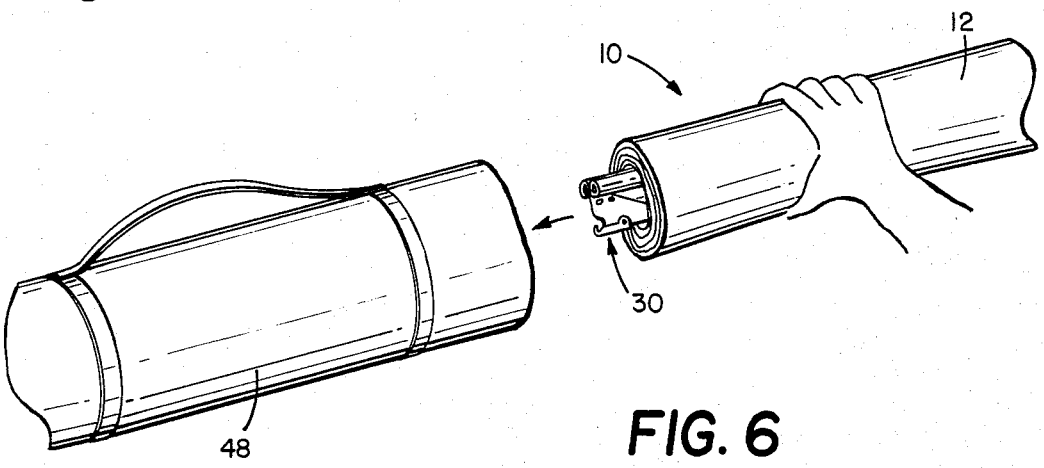
FIG. 6 is a perspective view showing the invention in a collapsed state ready for storage.

FIG. 6 shows the perspective view of the portable collapsible shelter 10 as it would look when ready for storage in its hand-carry bag 48.

The present invention comprises a compact, lightweight shelter which is easy to assemble. When fully assembled, this invention provides an attractive protective shelter for several people.

While the above invention has been described in accordance with the preferred embodiment, it should be understood that various changes and modifications can be made in the specifications of the invention without detracting from the invention in its broadest form.

What is claimed is:

1. A portable, collapsible shelter comprising:

a flexible covering material;

a means for stretching said flexible covering material to a predetermined shape; and a frame means for receiving and supporting said flexible covering material, said frame means including a tripod means for erecting and collapsing said shelter, and interconnecting means for pivotally securing said tripod means and said frame means further including a central support rod and said stretching means includes at least one stretch bow supported on said central support rod at one end thereof.

2. A portable collapsible shelter as defined in claim 1 wherein said interconnecting means further include means for removably securing said stretch bow thereto.

3. A portable collapsible shelter as defined in claim 2 wherein said stretching means further includes a second stretch bow supported on the opposite end of said central support rod.

4. A portable collapsible shelter as recited in claim 3, which further includes anchoring means including a plurality of bags for receiving a weighted material and a means for attaching said bags to said tripod means.

5. A portable collapsible shelter comprising:

a flexible covering material defining a pair of sleeves therein;

first and second stretch bows received within said sleeves for stretching said flexible covering material to a desired shape;

a central support rod for supporting said stretch bows and said flexible covering material;

first, second and third leg means; and interconnecting means for attaching said first leg to one end of said central support rod and said second and third legs to the other end of said central support rod to form effectively a tripod means for supporting the central support rod, stretch bows and flexible covering material above the ground.

6. A portable collapsible shelter as defined in claim 5 wherein said interconnecting means further includes means for pivotally securing each of said legs to said central support rod.

7. A portable collapsible shelter as defined in claim 6 wherein said interconnecting means further includes securing means for retaining said first and second stretch bows at opposite ends of said central support member.

8. A portable collapsible shelter as defined in claim 7 wherein said securing means includes first and second pairs of spring biased clamping jaws for gripping said stretch bows.

9. A portable collapsible shelter as defined in claim 7 wherein said securing means includes a pivotally disposed tongue member supported at each end of said central support rod.

10. A portable collapsible shelter as defined in claim 9 wherein said first and second stretch bows each include at least two sections interconnected by an elastic member and further including a cylindrical sleeve slidable to cover said elastic member and to provide an integral stretch bow.

11. A portable collapsible shelter as defined in claim 10 wherein said interconnecting means includes a pair of plates secured to one end of said central support rod with said first leg pivotally secured therebetween.

12. A portable collapsible shelter as defined in claim 10 wherein said interconnecting means includes at least three plate members affixed to the opposite end of said central support rod and pivotally securing said second and third legs in an angularly disposed position, so that said legs diverge from said central support member.

13. A portable collapsible shelter as defined in claim 12, said first, second and third legs each comprised of at least two sections, one slidably disposed within the other for providing adjustment of said shelter to fit the particular terrain upon which it is erected.

14. A portable collapsible shelter as defined in claim 13 wherein said central support rod includes at least two sections, one slidably received within the other.

15. A portable collapsible shelter as defined in claim 5 wherein said stretch bows are flexible members constructed of fiber glass material.

* * * * *